US012209337B2

(12) United States Patent
Szilagyi

(10) Patent No.: US 12,209,337 B2
(45) Date of Patent: Jan. 28, 2025

(54) KNITTED GARMENTS HAVING COLORED REGIONS AND TEXTURED ELEMENTS AND METHODS OF FORMING THE SAME

(71) Applicant: adidas AG, Herzogenaurach (DE)

(72) Inventor: Dora Szilagyi, Brooklyn, NY (US)

(73) Assignee: adidas AG, Herzogenaurach (DE)

( * ) Notice: Subject to any disclaimer, the term of this patent is extended or adjusted under 35 U.S.C. 154(b) by 29 days.

(21) Appl. No.: 16/677,292

(22) Filed: Nov. 7, 2019

(65) Prior Publication Data

US 2021/0140079 A1 May 13, 2021

(51) Int. Cl.

| | |
|---|---|
| ***A41B 1/08*** | (2006.01) |
| ***D04B 1/12*** | (2006.01) |
| ***D04B 1/24*** | (2006.01) |
| ***D04B 21/08*** | (2006.01) |
| ***D04B 21/16*** | (2006.01) |

(52) U.S. Cl.

CPC ..... *D04B 21/16* (2013.01); *A41B 1/08* (2013.01); *D04B 1/126* (2013.01); *D04B 1/24* (2013.01); *D04B 21/08* (2013.01); *A41D 2500/10* (2013.01)

(58) Field of Classification Search

None

See application file for complete search history.

(56) References Cited

U.S. PATENT DOCUMENTS 265,296 A * 10/1882 Adgate ..... D04B 15/80 66/42 R
296,119 A * 4/1884 Bourn ..... A43B 3/02 36/4
1,702,608 A * 2/1929 Lawson et al. ..... D04B 9/32 66/145 R
2,010,187 A * 8/1935 Grothey ..... D04B 9/28 66/185
2,161,324 A * 6/1939 Thomas ..... D04B 9/28 66/201
2,899,812 A * 8/1959 Attenborough ..... D04B 1/24 66/203

(Continued)

FOREIGN PATENT DOCUMENTS

GB 366991 A * 2/1932 ..... D04B 1/126
WO WO-2016194763 A1 * 12/2016 ..... A41D 7/00

OTHER PUBLICATIONS

Hunter, Billy. "Shima Seiki: SWG-X." Knitting Industry—Keeping You in the Loop, Apr. 7, 2009, https://www.knittingindustry.com/shima-seiki-swg-x/. (Year: 2009).*

(Continued)

*Primary Examiner* — Grace Huang

(74) *Attorney, Agent, or Firm* — Sterne, Kessler, Goldstein & Fox P.L.L.C.

(57) ABSTRACT

A method of knitting an article of apparel includes knitting a first region using a first yarn of a first color and knitting a second region using a second yarn of a second color that differs from the first color. Knitting the first region and knitting the second region forms at least a portion of a color layout of the article of apparel. The method further includes knitting a textured element into at least one of the first region and the second region with at least one of the first yarn and the second yarn. The textured element has a layout that differs from the color layout.

19 Claims, 8 Drawing Sheets

(56) References Cited

U.S. PATENT DOCUMENTS 3,553,066 A * 1/1971 Cavalier ..... D06C 29/00 428/172
3,808,843 A * 5/1974 Blore ..... D04B 1/126 66/196
3,825,900 A * 7/1974 Anderson ..... D04B 15/99 66/25
3,955,227 A * 5/1976 Siegfried ..... A41B 11/00 8/150
3,983,370 A * 9/1976 Caspi ..... D04B 15/66 66/219
4,034,581 A * 7/1977 Swafford ..... D04B 1/26 66/136
4,346,366 A * 8/1982 Kajiura ..... G06T 1/0007 700/141
4,505,134 A * 3/1985 Essig ..... D04B 15/56 66/60 R
4,612,784 A * 9/1986 Plath ..... D04B 9/12 66/107
5,369,966 A * 12/1994 Morita ..... D04B 7/26 66/125 R
5,557,948 A * 9/1996 Shima ..... D04B 1/12 66/106
5,566,396 A * 10/1996 Leib ..... D04B 1/26 2/239
5,818,720 A * 10/1998 Grigalunas ..... D03C 19/005 700/133
5,819,558 A * 10/1998 Takegawa ..... D04B 15/66 66/61
5,834,879 A * 11/1998 Watanabe ..... D03C 3/20 310/330
6,068,538 A * 5/2000 Alleyne ..... A41C 3/0057 450/1
6,073,468 A * 6/2000 Wallace ..... D04B 1/10 66/202
7,428,772 B2 * 9/2008 Rock ..... D04B 1/24 28/159
7,430,882 B2 * 10/2008 Nakayama ..... D04B 1/126 66/170
7,555,921 B2 * 7/2009 Thompson ..... A41D 19/0096 2/159
8,424,116 B2 * 4/2013 Anastsopoulos ..... D04B 1/26 2/239
8,958,902 B2 * 2/2015 Levine ..... D04B 1/126 700/141
9,015,863 B2 * 4/2015 Brown ..... A41D 13/0015 2/69
9,226,540 B2 * 1/2016 Podhajny ..... D04B 1/22
9,232,823 B2 * 1/2016 Mitchell ..... D04B 1/246
9,575,229 B2 * 2/2017 Liles ..... G02B 27/06
10,030,328 B2 * 7/2018 Lonati ..... D04B 21/04
10,273,608 B2 * 4/2019 Chiu ..... D04B 21/08
10,321,738 B2 * 6/2019 Lyke ..... A43B 23/021
10,575,569 B2 * 3/2020 Montoya ..... A41D 31/065
10,597,805 B2 * 3/2020 Takahashi ..... D04B 21/12
10,645,978 B2 * 5/2020 Kehler ..... A41D 1/04
10,669,657 B2 * 6/2020 Achtymichuk ..... D04B 1/24
10,822,728 B2 * 11/2020 Meir ..... A43B 23/04
10,863,795 B2 * 12/2020 Larson ..... A43B 3/0078
10,918,149 B2 * 2/2021 Pilipenka ..... A41D 27/10
11,047,068 B2 * 6/2021 Ezer ..... D04B 21/14
11,134,724 B2 * 10/2021 Maheshwari ..... A41C 3/12
11,293,124 B2 * 4/2022 Morgan ..... A41H 43/00
11,304,473 B2 * 4/2022 Whiteman ..... A43B 23/025
2004/0097148 A1 * 5/2004 Tucker, Jr. ..... D03D 13/004 442/205
2006/0080754 A1 * 4/2006 Baron ..... A41D 13/0015 2/85
2007/0079427 A1 * 4/2007 Herbert ..... A41B 9/00 2/403
2007/0094762 A1 * 5/2007 Carter ..... D04B 21/207 2/69
2010/0275342 A1 * 11/2010 Sweeney ..... D04B 1/126 2/167
2013/0305788 A1 * 11/2013 Atmanspacher ..... D02G 3/328 57/15
2013/0312284 A1 * 11/2013 Berend ..... A43B 1/0072 36/84
2015/0033438 A1 * 2/2015 Middo ..... A41D 27/08 2/69
2019/0093264 A1 * 3/2019 Erickson ..... D04B 9/12
2019/0218694 A1 * 7/2019 Lin ..... D04B 1/126
2019/0309449 A1 * 10/2019 Chikada ..... D03D 3/08
2019/0345652 A1 * 11/2019 Mon ..... D06Q 1/02
2020/0121019 A1 * 4/2020 Bartys ..... D04B 1/24
2020/0318266 A1 * 10/2020 Rose ..... D04B 1/16
2021/0071326 A1 * 3/2021 Tibbits ..... D04B 1/22
2021/0100293 A1 * 4/2021 Kaylin ..... A41C 3/0057

OTHER PUBLICATIONS

"Marvel X-Men Wolverine Vintage Claw Slice Graphic T-Shirt". The Marvel Store. Nov. 8, 2018. https://www.amazon.com/Marvel-Wolverine-Vintage-Graphic-T-Shirt/dp/B07K9C72V4/ref=sr_1_2?keywords=Wolverine%2BT-Shirt&qid=1692049327&sr=8-2&customId=B0752XJYNL&customizationToken=MC_Assembly_1%23B0752XJYNL&customizationToken=MC_Assembly_1%23B0752XJYNL&th=1 (Year: 2018).*
Fisherman's rib in 2 colors: a Knittycat's Knits tutorial. Knittycat's Knits. Aug. 28, 2018. https://www.youtube.com/watch?v=MBVT0i6d5xA (Year: 2018).*
"How to Knit a Cowl for the Absolute Beginner." Fiber Flux. Sep. 26, 2017. https://www.youtube.com/watch?v=2oCysuarwEE (Year: 2017).*
"How to Knit a Scarf for the Absolute Beginner." Fiber Flux. Mar. 14, 2018. https://www.youtube.com/watch?v=UHIsW0wl144 (Year: 2018).*
"Fisherman's rib scarf in 1 color: a Knittycat's Knits Project (minute 2:41)." Knittycat's Knits. Jul. 26, 2018. https://www.youtube.com/watch?v=xiNZMcTCKgM (Year: 2018).*
"How to Knit a Scarf for Complete Beginners Step-by-Step (4:44)." B.Hooked Crochet. Sep. 21, 2019. https://www.youtube.com/watch?v=vy9sHGh2jFQ&t=107s (Year: 2019).*
"Intarsia." Oxford Dictionary. Jan. 22, 2024. (Year: 2024).*
Jen. "Epic Tale of a Sweater for Jon." Grainline Studio. Jul. 16, 2018. https://grainlinestudio.com/blogs/blog/the-epic-tale-of-a-sweater-for-jon (Year: 2018).*
"Fisherman's rib scarf in 1 color: a Knittycat's Knits Project (minute 3:05)." Knittycat's Knits. Jul. 26, 2018. https://www.youtube.com/watch?v=xiNZMcTCKgM (Year: 2018).*
"Fisherman's rib scarf in 1 color: a Knittycat's Knits Project (minute 3:07)." Knittycat's Knits. Jul. 26, 2018. https://www.youtube.com/watch?v=xiNZMcTCKgM (Year: 2018).*
"Fisherman's rib scarf in 1 color: a Knittycat's Knits Project (minute 2:08)." Knittycat's Knits. Jul. 26, 2018. https://www.youtube.com/watch?v=xiNZMcTCKgM (Year: 2018).*
"Fisherman's rib scarf in 1 color: a Knittycat's Knits Project (minute 0:07)." Knittycat's Knits. Jul. 26, 2018. https://www.youtube.com/watch?v=xiNZMcTCKgM (Year: 2018).*
"Fisherman's rib scarf in 1 color: a Knittycat's Knits Project: Transcript." Knittycat's Knits. Jul. 26, 2018. https://www.youtube.com/watch?v=xiNZMcTCKgM (Year: 2018).*
"How to Knit a Scarf for Complete Beginners Step-by-Step:transcript." B. Hooked Crochet. Sep. 21, 2019. https://www.youtube.com/watch?v=vy9sHGh2jFQ&t=107s (Year: 2019).*

* cited by examiner

KNITTED GARMENTS HAVING COLORED REGIONS AND TEXTURED ELEMENTS AND METHODS OF FORMING THE SAME

FIELD

Embodiments described herein generally relate to knitted articles of apparel and methods for knitting articles of apparel. Specifically, embodiments described herein relate to knitted articles of apparel having colored regions and textured elements incorporated into the same article of apparel.

BRIEF SUMMARY

Some embodiments relate to a method of knitting an article of apparel that includes knitting a first region using a first yarn of a first color and knitting a second region using a second yarn of a second color that differs from the first color. Knitting the first region and knitting the second region forms at least a portion of a color layout of the article of apparel. In some embodiments, the method includes knitting a textured element into at least one of the first region and the second region with at least one of the first yarn and the second yarn. In some embodiments, the textured element has a layout that differs from the color layout.

In any of the various embodiments discussed herein, the textured element may include a structural area that contrasts with a structural area of the first region or the second region outside of the textured element.

In any of the various embodiments discussed herein, the method may further include knitting a third region using a third yarn having a third color that differs from the first color and the second color. In some embodiments, knitting the third region forms a portion of the color layout of the article of apparel.

In any of the various embodiments discussed herein, knitting the first region and knitting the second region may include intarsia knitting.

In any of the various embodiments discussed herein, knitting the first region and knitting the second region may include knitting using an 18 gauge knitting machine.

In any of the various embodiments discussed herein, knitting the first region and knitting the second region may include flat knitting.

In any of the various embodiments discussed herein, the first yarn may include a yarn made of polyamide, nylon, elastane, or polyester.

In any of the various embodiments discussed herein, the textured element forms one or more characters, artwork, or graphic elements.

In any of the various embodiments discussed herein, the knitted article may be a shirt, a jacket, pants, leggings, a sports bra, or a shoe upper.

In any of the various embodiments discussed herein, the method may further include knitting a mesh portion, a single jersey portion, or a half Milano portion into at least one of the first region or the second region.

Some embodiments relate to a method of knitting an article of apparel that includes forming a color layout of the article of apparel by knitting a first region using a first yarn, knitting a second region using a second yarn, and knitting a third region using a third yarn. The first yarn, second yarn, and third yarn may each have a different color. The method may also include forming a textural graphic layout by knitting a textured element into at least one of the first region, the second region, and the third region. In some embodiments, the textural graphic layout is different than the color layout.

In any of the various embodiments discussed herein, knitting the first region, the second region, and the third region may include intarsia knitting.

In any of the various embodiments discussed herein, knitting the first region, the second region, and the third region may include knitting using an 18 gauge knitting machine.

In any of the various embodiments discussed herein, the textured element is knitted into at least two of the first region, the second region, and the third region.

In any of the various embodiments discussed herein, the textured element comprises a recessed or raised area.

Some embodiments relate to a knitted article of apparel that includes a first knitted region including a first yarn having a first color, a second knitted region including a second yarn having a second color that differs from the first color, and a textured element knitted into at least one of the first knitted region or the second knitted region, wherein the first knitted region and the second knitted region form at least a portion of a color layout, wherein the textured element has a layout that differs from the color layout, and wherein the textured element differs structurally from the first knitted region or the second knitted region.

In any of the various embodiments discussed herein, the first yarn may include a yarn made of polyamide, nylon, elastane, or polyester.

In any of the various embodiments discussed herein, the textured element may form one or more characters, artwork, or graphic elements.

In any of the various embodiments discussed herein, the knitted article is a shirt, a jacket, pants, leggings, a sports bra, or a shoe upper.

In any of the various embodiments discussed herein, the knitted article may further include a mesh portion arranged in at least one of the first knitted region and the second knitted region.

BRIEF DESCRIPTION OF THE DRAWINGS/FIGURES

The accompanying drawings, which are incorporated herein and form a part of the specification, illustrate the present disclosure and, together with the description, further serve to explain the principles thereof and to enable a person skilled in the pertinent art to make and use the same.

DETAILED DESCRIPTION

Reference will now be made in detail to representative embodiments illustrated in the accompanying drawings. It should be understood that the following descriptions are not intended to limit the embodiments to one preferred embodiment. To the contrary, it is intended to cover alternatives, modifications, and equivalents as can be included within the spirit and scope of the described embodiments as defined by the claims.

Articles of apparel may be used for both functional and aesthetic purposes. Color and texture may be used to provide a desired aesthetic. Greater variety in visual appearance of articles of apparel may be desired. Embodiments described herein provide greater variety by using a color layout (an arrangement of colored regions with different colors) to provide a particular aesthetic and a separate textural layout (an arrangement of a textured element or structure in a knitted garment) that provides an additional aesthetic. The combination of the color layout and the textural layout provides a particular visual appearance to a knitted article. The layouts may overlap with each other to provide a layered appearance. Thus, the colored graphics from the color layout and the textural graphics from the textural element together provide a unique visual appearance to the knitted article.

A knitted article may include an upper body garment, such as a shirt, a tank top, a jacket, a short-sleeve T-shirt, a long-sleeve T-shirt, a sports bra, etc.; bottoms, such as shorts, leggings, pants, a skirt, etc.; or a footwear component, such as a shoe upper, among others garments and articles. Further, the knitted article may be a portion of a garment, such as a sleeve of a shirt, or a pant leg, among others. Knitted articles may be used as athletic apparel or sportswear.

Figure 1:
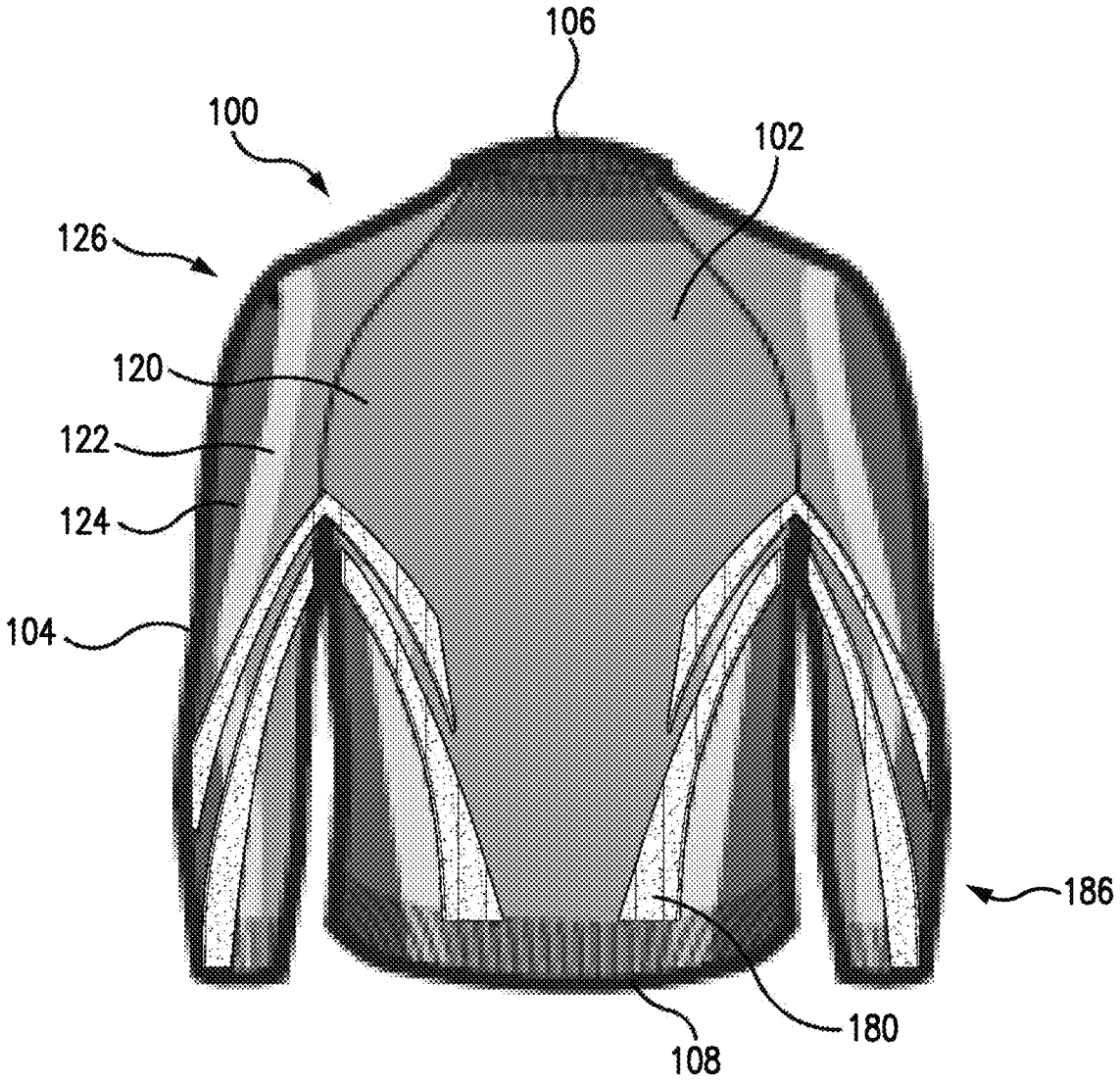
FIG. 1 shows a front view of a knitted article including colored regions and a textured element according to an embodiment.

A knitted article 100 having a combination of colored regions and textured elements is shown for example at FIG. 1. Knitted article 100 is formed as a long-sleeve shirt in FIG. 1. However, it is understood that knitted article 100 is not limited to a long-sleeve shirt, and knitted article may be formed as any of various garments, including shorts, pants, leggings, t-shirts, jackets, sports bras, and shoe uppers, among others.

Knitted article 100 of FIG. 1 includes a torso 102 and arms 104. Further, knitted article 100 includes a neck portion 106 and a waist portion 108.

Knitted article 100 includes colored regions, and may include a first region 120 of a first color and a second region 122 of a second color. In some embodiments, knitted article 100 may include multiple first regions 120 or multiple second regions 122. Knitted article 100 is formed so as to have two or more regions or blocks of color. First region 120 may be adjacent to second region 122. For example, a first region having a first color may be a lower half of a garment, and a second region having a second color may be an upper half of the garment. In some embodiments, a first region having a first color may be a back portion of a garment, and a second region having a second color may be a front portion of a garment. Other regions may also be used. In some embodiments, the regions are defined by the boundaries between different colors. Other than a change in color, there may not be a visible boundary between regions (e.g., knitted article 100 may be seamless between different regions).

In some embodiments, knitted article 100 may further include a third region 124 of a third color as shown in FIG. 1. Further, knitted article 100 may include fourth, fifth, or additional colored regions as desired to form an article 100 with a desired appearance. The colored regions may form a color layout 126, thus providing a particular visual appearance to knitted article 100. Color layout 126 may refer to a design or arrangement of colors. For example, color layout 126 may be made up of two or more regions of different colors and defined by the shape and/or location of each of the colored regions.

In some embodiments, knitted article 100 further includes a textured element 180. In some embodiments, knitted article 100 may include multiple textured elements 180. Textured element 180 may include a structural area that contrasts with, and differs from, a structural area of the knitted article outside of textured element 180. For example, textured element 180 may include a knit pattern that differs from a knit pattern of an area of knitted article outside of textured element 180. Textured element 180 can be visually distinguished from a structural area outside of textured element 180, such as an area around or adjacent to textured element 180. In some embodiments, textured element 180 may be raised or recessed relative to a remainder of knitted article 100. In such embodiments, knitted article 100 may include an elastic yarn, such as an elastane yarn, which may be used to provide textured element 180 with a raised or recessed structural area. In some embodiments, textured element 180 may be formed from the same yarn or yarns used to form colored regions 120, 122, 124 of knitted article 100.

In some embodiments, textured element 180 may include text, such as characters, including letters and numbers, for example, as discussed below for FIG. 2. In this way, textured element 180 may spell a word or phrase. Textured element 180 may alternatively or additionally include artwork or graphic elements, such as a flower, a star, or a logo, among various others. Textured element 180 may be arranged in any of various patterns, such as one or more stripes (which may be linear or non-linear) or waves. Further, textured element 180 may be arranged on various portions of knitted article 100. For example, textured element 180 may be arranged on arm 104 of an upper body garment, such as a shirt or jacket, as shown for example in FIG. 1. Textured element 180 may extend along a length of the arm 104 of the shirt or jacket, such as along a length of the upper arm and/or the lower arm.

The arrangement and/or location of textured element 180 may form a layout 186 (e.g., a design or arrangement of texture) for textured element 180, thus providing a particular visual appearance to knitted article 100. Layout 186 may give a textural graphic separate from the graphic provided by color layout 126. In some embodiments, layout 186 is disposed over color layout 126 (e.g., a portion of layout 186 overlaps with a portion of color layout 126). Layout 186 may differ from color layout 126. For example, in some embodiments, a pattern of the textured element(s) 180 do not correspond to the pattern of the colored regions 120, 122, 124. For example, a textured element 180 may extend across borders between colored regions 120, 122, 124, instead of corresponding to the borders between colored regions 120, 122, 124 (see FIG. 1). As another example, if the colored regions 120, 122, 124 are formed as horizontal stripes, the textured 180 element may be formed as a vertical stripe or diagonal stripe, among various other patterns. In FIG. 1, an arm 104 of article 100 includes colored regions 120, 122, 124 extending generally longitudinally along a length of arm 104, and textured element 180 is arranged diagonally so as to extend from an outer side of arm 104 to an inner side of arm 104 (and also to extend diagonally on torso 102), such that textured element 180 crosses colored regions 120, 122, 124. Thus, the colored graphics from color layout 126 and the textural graphics from textural element 180 together provide a unique visual appearance to the knitted article 100.

Figure 2:
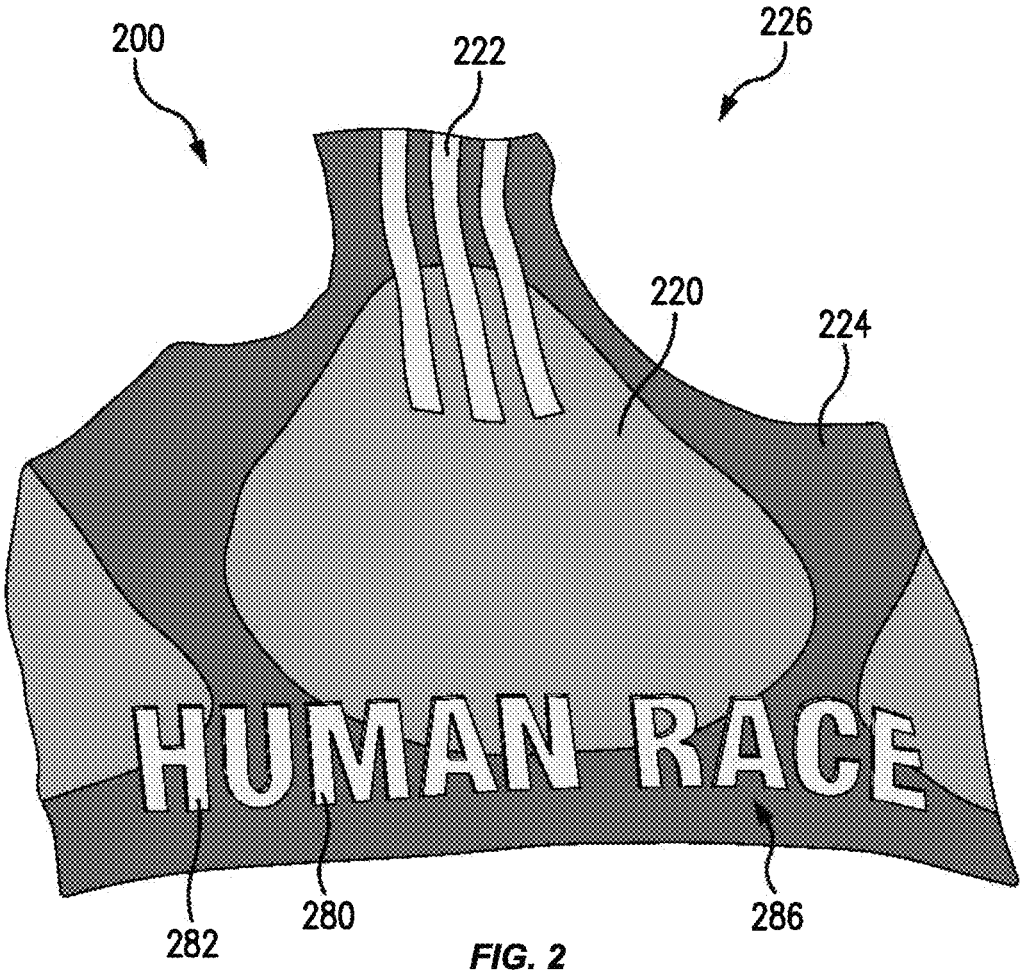
FIG. 2 shows a back view of a knitted article including colored regions and a textured element according to an embodiment.
Figure 3:
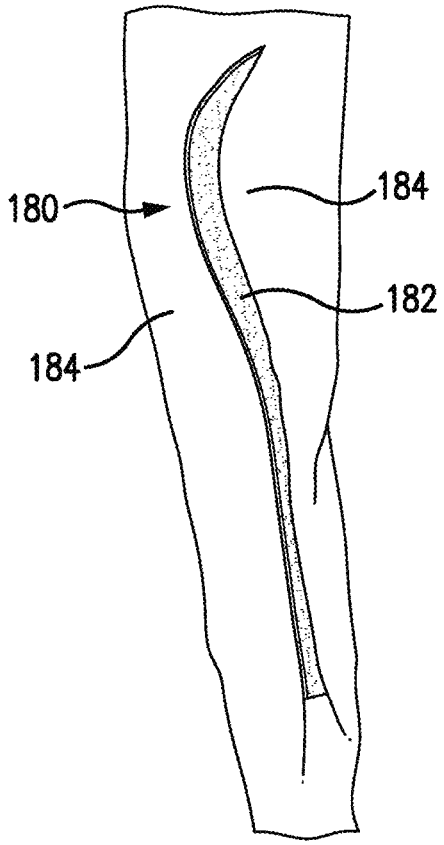
FIG. 3 shows a close-up view of a textured element according to an embodiment.

In some embodiments, as shown for example in FIG. 2, a knitted article 200 may be formed as a sports bra. Similar to knitted article 100, knitted article 200 includes a first region 220 of a first color and a second region 222 of a second color. In some embodiments, knitted article 400 may further include a third region 224 of a third color. Colored regions 220, 222, 224 are formed into a color layout 226. Knitted article 200 may also include a textured element 280. As discussed above, textured element 280 may include characters 282, which may be letters and/or numbers. Textured element 280 may comprise a layout 286. In some embodiments, layout 286 forms one or more words made of characters 282. In some embodiments, as shown in FIG. 3, textured element 180 may be formed as a recessed area or tunnel 182 relative to adjacent portions 184 of knitted article. However, in some embodiments, textured element 180 may instead be formed as a raised area. Textured element 180 may be arranged on at least one colored region of knitted article 100, and may be arranged on multiple colored regions. Any of the textured elements (e.g., textured element 280) discussed herein may have similar features as textured element 180.

Figure 4:
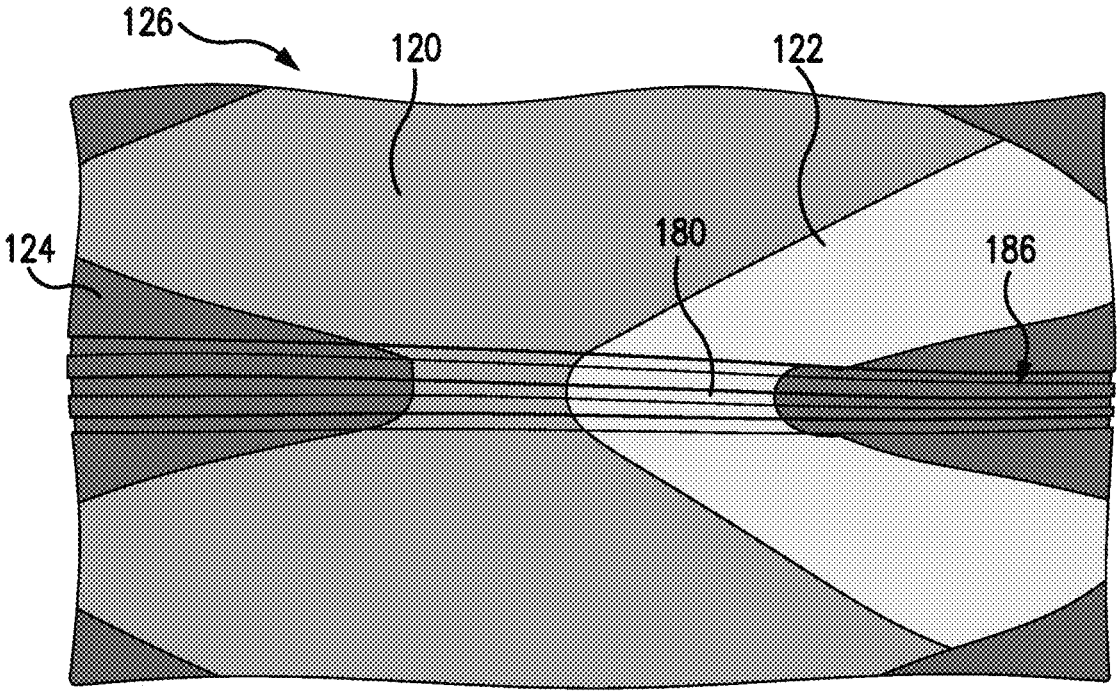
FIG. 4 shows colored regions and a textured element according to an embodiment.
Figure 5:
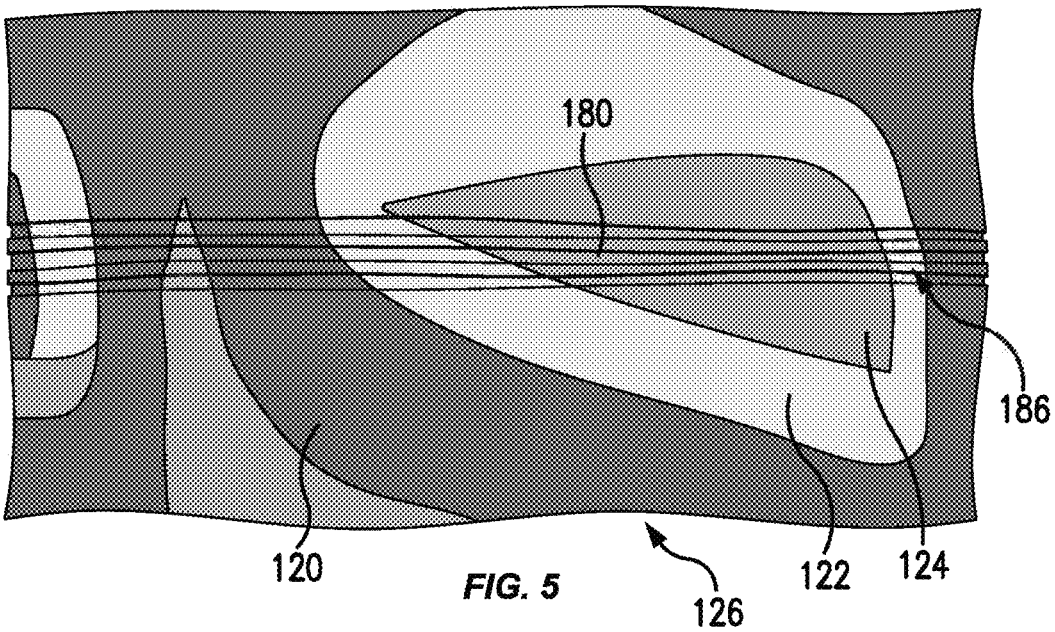
FIG. 5 shows colored regions and a textured element according to an embodiment.
Figure 6:
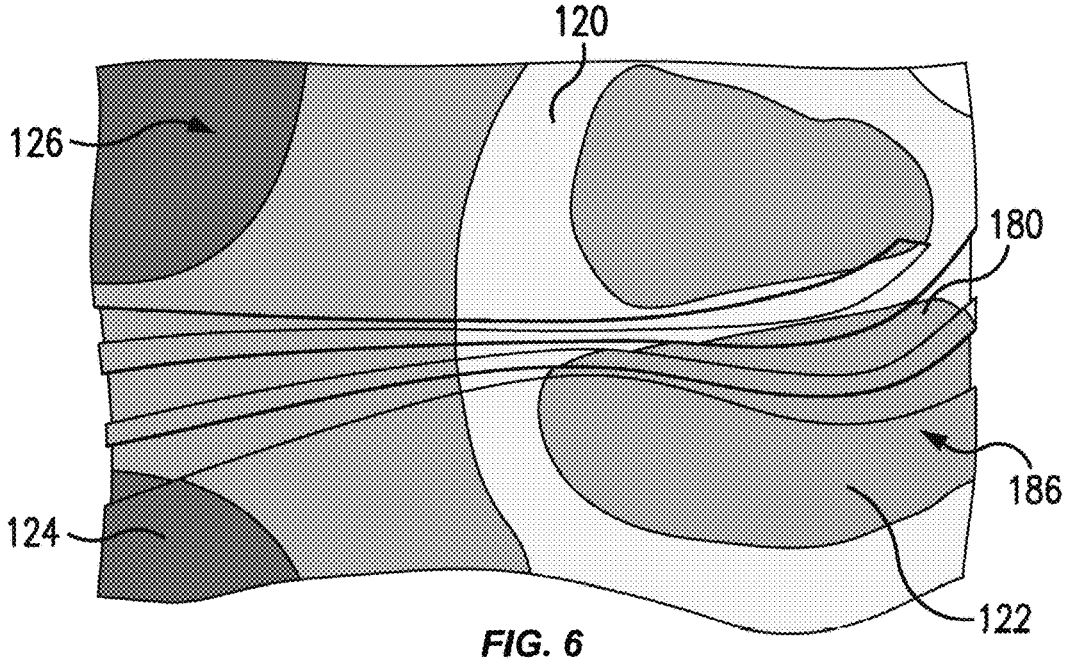
FIG. 6 shows colored regions and a textured element according to an embodiment.

Additional configurations for color layout 126 and layout 186 that may be used in knitted articles are shown, for example, in FIGS. 4-6. In some embodiments, layout 186 of texture element 180 may comprise one or more stripes, which may be formed by raised or recessed areas. Layout 186 may extend across three colored regions 120, 122, 124. The different patterns of color layout 126 and layout 186 may form a layered aesthetic, as shown in FIGS. 4-6. Alternative configurations may also be used.

Figure 7:
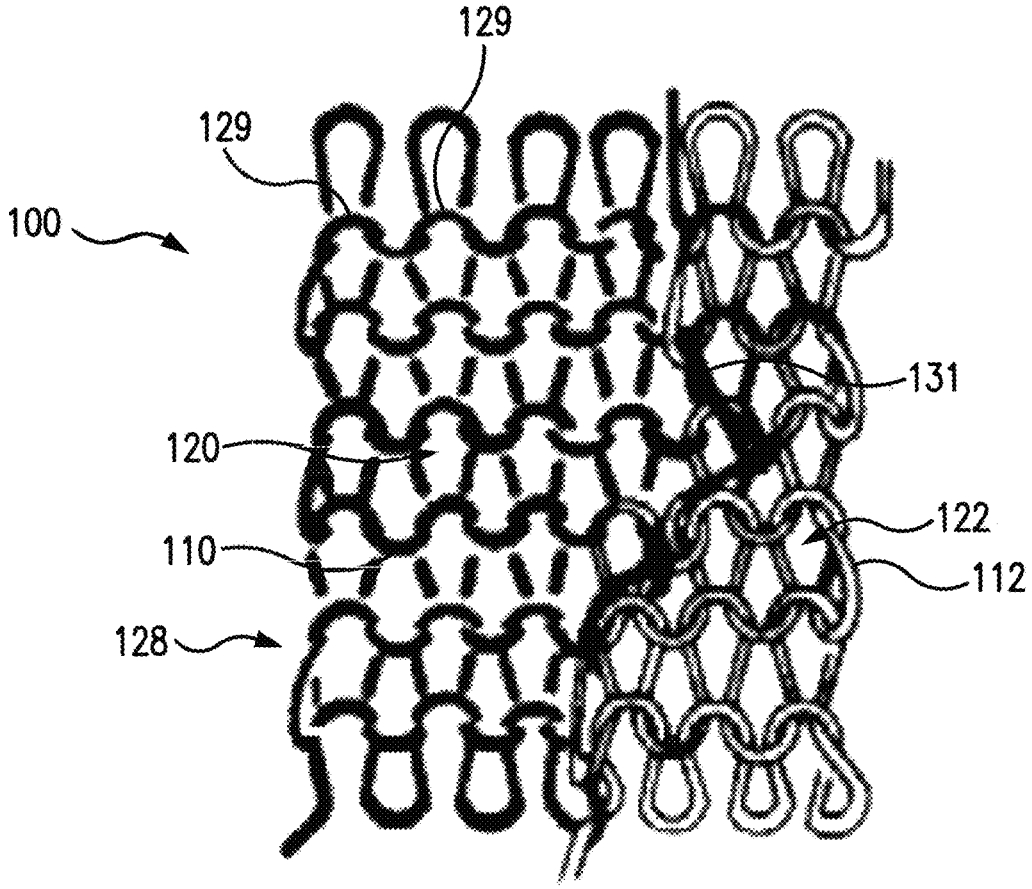
FIG. 7 shows a close-up view of an intarsia knitting pattern.

Knitted article 100 may be knitted using two or more yarns, as shown for example in FIG. 7. Knitted article 100 may include a first yarn 110 for knitting first region 120, and a second yarn 112 for knitting second region 122. First yarn 110 may have a first color and second yarn 112 may have a second color. First color may be different from second color. For example, first color may be white, and second color may be gray. Any of various combinations of colors may be used as will be appreciated by one of ordinary skill in the art. First region 120 and second region 122 may meet at a border 131.

In some embodiments, knitted article 100 may further include a third yarn having a third color that is different from the first color or second color. Thus, knitted article 100 may further include a third region 124 of the third color (see FIG. 1) that differs from the first and second colors. For example, first region 120 may be white, second region 122 may be gray, and third region 124 may be black. Third region 124 may be adjacent to first region 120, the second region 122, or both. Third region 124 is separated from each of first and second regions 120, 124 by a border 131. In some embodiments, the first, second and third regions 120, 122, 124 may form the entire knitted article 100 (e.g., no other regions are present).

Knitted article 100 may include performance specific yarn (e.g., to achieve a particular characteristic or function of knitted article 100). For example, knitted article 100 may include yarn made from polyamide, nylon, elastane, polyester, or a combination thereof. In some embodiments, first yarn 110, second yarn 112, and/or a third yarn may be made from polyamide, nylon, elastane, polyester, or a combination thereof. Each yarn may be dyed so as to have a particular color. In some embodiments, the yarn may be dope dyed yarn.

In some embodiments, knitted article 100 may be flat knitted using a flat knitting machine. In some embodiments, knitted article 100 may be knitted using an 18 gauge knitting machine. Gauge refers to the number of needles (and correspondingly stitches) in one inch width of the machine needle bed. Increasing the gauge, and thus the needles (and stitches) per inch, increases the fineness of the knitted article. In some embodiments, knitted article 100 may be knit using a 14 gauge knitting machine. However, the visual effect of the combined colored regions and textured regions may be diminished at gauges lower than 14 gauge. Increased gauge allows for formation of finer, more precise patterns.

In some embodiments, knitted article 100 or a portion thereof may be formed by intarsia knitting as shown in FIG. 7. Intarsia is a knitting color technique that facilitates knitting blocks of color. Each color block (e.g., colored region 120, 122, 124) is formed with a separate yarn of a particular color. Unlike other knitting techniques, the yarn for a particular color block is only located within the region of that color block rather than being floated across the back of the garment.

The knitting machine may have a yarn feeder associated with each color block. During knitting, each yarn feeder moves across the machine such that it feeds yarn only to those needles that will form the associated color block. For example, there may be a yarn feeder associated with colored region 120 that feeds yarn 110 to those needles that are located in the machine at a place that can form the desired shape of colored region 120. There may be a separate yarn feeder associated with colored region 122 that feeds yarn 112 to those needles that are located in the machine at a place that can form the desired shape of colored region 122. Additional yarn feeders may be used (e.g., for colored region 124).

Each region 120, 122, 124 may include a plurality of courses 128 each having a plurality of stitches 129. One course 128 may extend across two or more regions 120, 122, 124, as shown, for example, in FIG. 7. One course 128 may include more stitches in region 120 (or regions 122, 124) than another course 128 in the same region. For example, the upper courses 128 have more stitches in region 120 than the lower courses 128 in region 120. Thus, the motion of yarn feeders may change from course to course such that it feeds yarn (e.g., yarn 110) to more or fewer needles of the knitting machine. Thus, in some embodiments, color layout 126 may be determined by the yarn feeders of the knitting machine.

The knitting machine may include one or more motorized carriers to control the needles during knitting. Thus, the motorized carrier(s) control the type of knitting stitches used to form knitted article 100 by controlling the needle movement. In some embodiments, layout 186 of textured element (s) 180 may be determined by the programming of the motorized carrier(s). For example, a different knitting stitch may be used in particular locations to form textured element 180. In some embodiments, textured element 180 may be formed with one or more of single jersey, half Milano, pique, rib, and/or mesh knitting stitches to provide textured element 180 with a contrasting structural area. Other knitting stitches may also be used to form textured element 180.

In some embodiments, the knitting program to form knitted article 100 is separated into two parts, including (1)

defining color layout 126 with the yarn feeder placement, and (2) defining textured element 180 (and its layout 186) with the programming of the carrier to form knitting stitches. Thus, color layout 126 may differ from layout 186, and the two different layouts may provide a layered aesthetic for knitted article 100.

In some embodiments, textured element 180 may be knitted simultaneously as colored regions 120, 122, 124 are knitted (for example as described above), such that a knitted article 100 having colored regions and textured elements may be formed in a single process. Alternatives to intarsia knitting may also be used. For example, in some embodiments, knitted article 100 may include colored regions or blocks formed by jacquard knitting.

Figure 8:
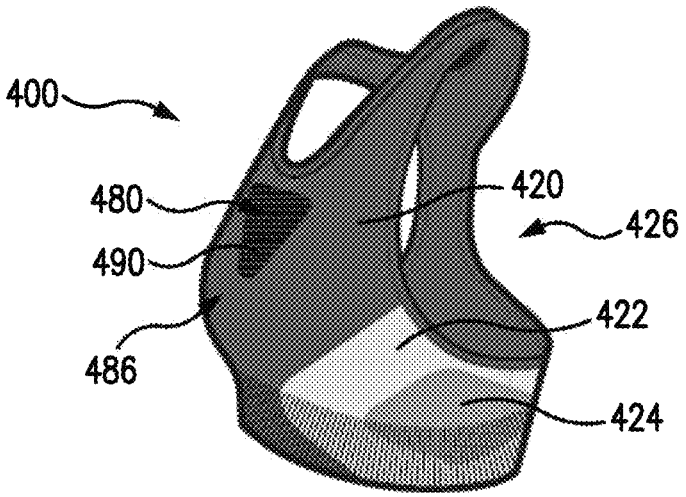
FIG. 8 shows a perspective view of a knitted article formed as a sports bra according to an embodiment.

In some embodiments, as shown for example in FIG. 8, a knitted article 400 may be formed as a sports bra. Similar to knitted article 100, knitted article 400 includes a first region 420 of a first color and a second region 422 of a second color. In some embodiments, knitted article 400 may further include a third region 424 of a third color.

In the illustrated embodiment, colored regions are formed with a color layout 426 in which third region 424 has a diamond shape, second region 422 surrounds third region 424 and is also generally diamond-shaped, and first region 420 surrounds second region 422 and makes up the remainder of knitted article 400. A different color layout may be used in some embodiments.

In some embodiments, knitted article 400 may further include a textured element 480. The arrangement and/or location of textured element 480 may form a layout 486 (e.g., a design or arrangement of texture) for textured element 480, thus providing a particular visual appearance to knitted article 400. In some embodiments, textured element 480 may be formed as a mesh portion 490. Mesh portion 490 may be knitted into first region 420, as shown in FIG. 8. However, in alternate embodiments, mesh portion 490 may be incorporated into various regions of article 400 or may span multiple colored regions 420, 422, 424. Mesh portion 490 may be formed in layout 486 that differs from color layout 426. For example in FIG. 8, mesh portion 490 is shown as having a triangular shape. Thus, colored regions 420, 422, 424 are formed in color layout 426 with a first pattern (e.g., diamond shapes), and mesh portion 490 is formed in layout 486 with a second pattern (e.g., a triangular pattern).

Figure 9:
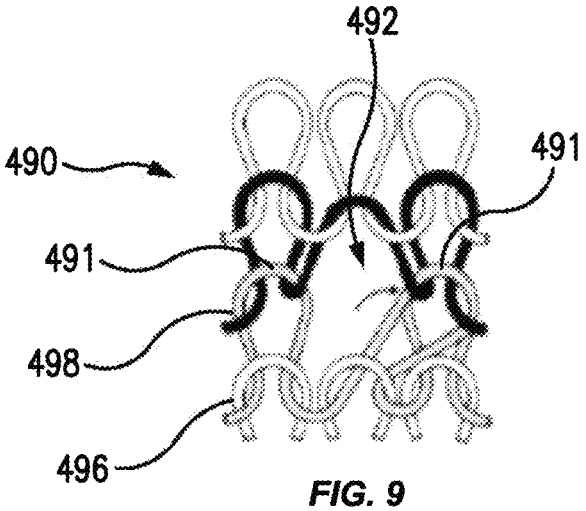
FIG. 9 shows a close-up view of a mesh knitting pattern.

Mesh portion 490 may be formed by a knitting pattern as shown for example in FIG. 9. Mesh portion 490 of knitted article 400 includes a series of stitch positions 491 and open stitch positions 492 resulting in an opening or aperture in knitted article 400 at a location of an open stitch position 492. Stitch positions 491 and open stitch positions 492 may alternate, or open stitch positions 492 may occur at a regular interval, such as by having an open stitch position 492 every two stitch positions, every three stitch positions, etc. Further, each course may include open stitch positions 492. Alternatively, as shown for example in FIG. 9, a first course 496 may lack open stitch positions and an adjacent, second course 498 may include open stitch positions 492. In this way, mesh portion 490 includes openings to provide increased air flow and breathability. This may help to keep the wearer cool while wearing a knitted article 400 having a mesh portion 490. Further, mesh portion 490 may allow a portion of a wearer's skin or a base layer beneath knitted article 400 to show through the open stitch positions formed by mesh portion 490 to provide a desired aesthetic appearance.

Figure 10:
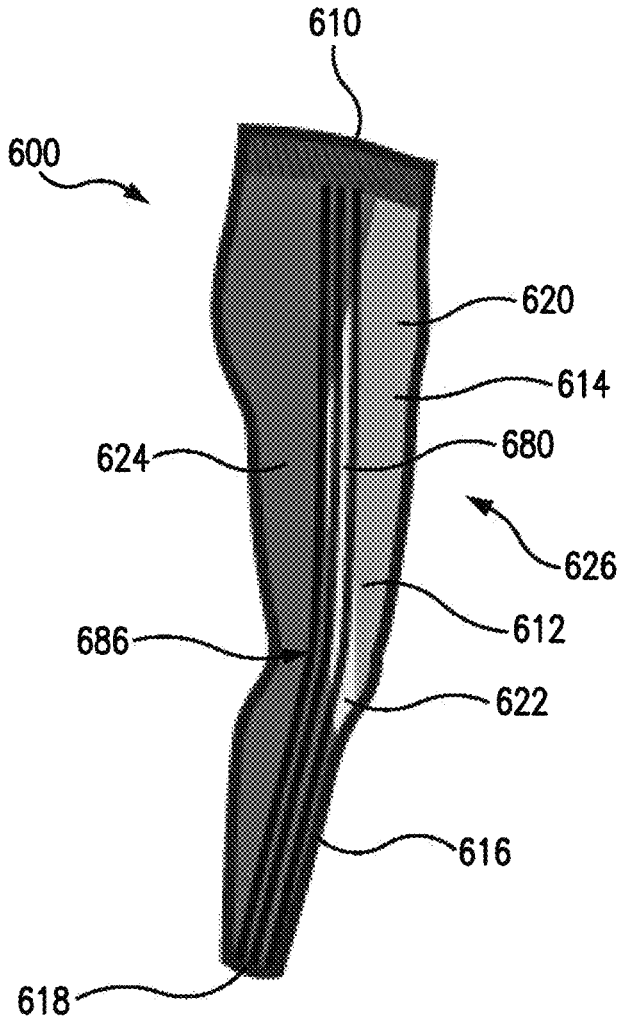
FIG. 10 shows a side view of a knitted article formed as a pair of leggings according to an embodiment.

In some embodiments, as shown for example in FIG. 10, a knitted article 600 may be formed as a pair of leggings. Similar to knitted articles 100, 400, knitted article 600 includes colored regions, such as a first region 620 of a first color, a second region 622 of a second color, and a third region 624 of a third color. In the illustrated embodiment, colored regions are formed with a color layout 626 in which first region 620 is arranged on a front portion of the thigh portion 614 of knitted article 600, and second region 622 is arranged along a side portion of knitted article 600 adjacent first region 620. Second region 622 may extend from a waistband 610 of knitted article 600 toward a knee portion 612. Third region 624 is arranged adjacent second region 622 and covers a remainder of knitted article 600, e.g., third region 624 covers a rear portion of thigh 614 of knitted article 600 and a calf or lower leg portion 616 of knitted article 600. However, in alternate embodiments, different regions may be arranged in different patterns on knitted article 600 to provide a desired appearance.

Knitted article 600 may further include a textured element 680. The arrangement and/or location of textured element 680 may form a layout 686 (e.g., a design or arrangement of texture) for textured element 680, thus providing a particular visual appearance to knitted article 600. In the illustrated embodiment, textured element 680 includes stripes that extend along an outer side of each leg of the leggings and the stripes extend from waistband 610 toward an ankle portion 618 of article 600. Stripes overlap each of first, second and third regions 620, 622, 624. Thus, colored regions are formed in color layout 626 with a first pattern, whereas textured element 680 is formed in layout 686 with a second pattern (e.g., stripes) that does not correspond to the first pattern.

Figure 11:
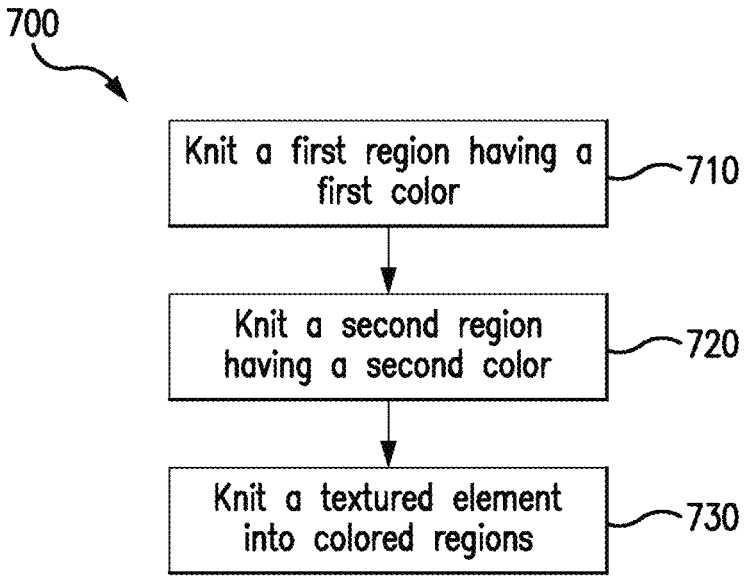
FIG. 11 shows a method of forming a knitted article according to an embodiment.

In some embodiments, a knitted article as described herein may be formed by a method 700 as shown in FIG. 11. A first yarn having a first color may be used to knit a first region of the knitted article at operation 710. First yarn may be knitted using an 18 gauge flat knitting machine. A second yarn having a second color that differs from the first color may be used to knit a second region of the knitted article at operation 720. In this way, the knitted article may include regions or blocks of different colors. In some embodiments, additional yarns may be used to knit additional regions, such as a third yarn used to knit a third region. The regions may be knit simultaneously. For example, each course may knit a portion of each region.

A textured region is knit into colored regions of knitted article at operation 730. Textured region may include a pattern that differs from a pattern of colored regions so as to provide additional visual interest. Thus, textured element may include a layout or pattern that is distinct from the layout or pattern of colored regions and that is not consistent with the pattern or layout of colored regions. Textured region may be knit into knitted article while colored regions are being knit, i.e., simultaneously with knitting of colored regions. In this way, a knitted article having colored regions and textured elements can be produced in a single process (e.g., without additional or subsequent processing steps). Once knitted article is knit, knitted article may be formed into a desired garment, such as by joining portions of knitted article to one another, jointing knitted article with other articles, or by performing finishing operations. For example, a knitted article may be one leg for leggings. The knitted article may be joined with a second knitted article that is the other leg of the leggings to form a final garment.

The foregoing description of the specific embodiments will so fully reveal the general nature of the invention that others can, by applying knowledge within the skill of the art, readily modify and/or adapt for various applications such specific embodiments, without undue experimentation, and without departing from the general concept of the present invention. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance herein.

The breadth and scope of the present invention should not be limited by any of the above-described exemplary embodiments, but should be defined only in accordance with the following claims and their equivalents.

What is claimed is:

1. A method of knitting an article of apparel using a knitting machine, the method comprising:

knitting a first region comprising a plurality of stitches arranged in a plurality of courses using a first yarn of a first color, wherein a first yarn feeder of the knitting machine feeds the first yarn to needles of the knitting machine;

knitting a second region comprising one or more stitches arranged in at least one course of the plurality of courses using a second yarn of a second color that differs from the first color, wherein a second yarn feeder of the knitting machine feeds the second yarn to the needles;

wherein the first region does not include stitches of the second yarn, wherein the second region does not include stitches of the first yarn, wherein the first yarn of the first region meets the second yarn of the second region at a boundary extending in a first direction, and wherein knitting the first region and knitting the second region forms at least a portion of a color layout of the article of apparel; and knitting a textured element into the first region with the first yarn and into the second region with the second yarn, wherein the knitting machine comprises a carrier that controls the needles to knit the textured element with stitches of a first knitting stitch and a remainder of the plurality of stitches in the first region with stitches of a second knitting stitch that differs from the first knitting stitch, wherein the first knitting stitch comprises single jersey, half Milano, pique, or mesh;

wherein the textured element extends lengthwise in a second direction across the boundary of the first region and the second region such that the textured element has a layout that differs from the color layout, and wherein the second direction is different than the first direction.

2. The method of claim 1, further comprising knitting a third region using a third yarn having a third color that differs from the first color and the second color, wherein knitting the third region forms a portion of the color layout of the article of apparel.

3. The method of claim 1, wherein knitting the first region and knitting the second region comprises intarsia knitting.

4. The method of claim 1, wherein knitting the first region and knitting the second region comprises knitting using an 18 gauge knitting machine.

5. The method of claim 1, wherein knitting the first region and knitting the second region comprises flat knitting.

6. The method of claim 1, wherein the first yarn comprises a yarn made of polyamide, elastane, or polyester.

7. The method of claim 1, wherein the textured element forms one or more words.

8. The method of claim 1, wherein the knitted article comprises a shirt, a jacket, pants, leggings, a sports bra, or a shoe upper.

9. The method of claim 1, further comprising knitting a mesh portion into at least one of the first region or the second region.

10. The method of claim 1, further comprising knitting the textured element using a knitting pattern that differs from a knitting pattern used to knit a remainder of the first region or the second region in which the textured element is knitted.

11. The method of claim 1, wherein the color layout comprises a first pattern, and the layout of the textured element comprises a second pattern that differs from the first pattern.

12. A method of knitting an article of apparel using a knitting machine, the method comprising:

forming a color layout of the article of apparel by controlling a first yarn feeder of the knitting machine to feed a first yarn to needles of the knitting machine to knit a first region using the first yarn, a second yarn feeder of the knitting machine to feed a second yarn to the needles to knit a second region using the second yarn, and a third yarn feeder of the knitting machine to feed a third yarn to the needles to knit a third region using the third yarn, wherein the first yarn, the second yarn, and the third yarn each have a different color, wherein the first region does not include stitches of the second yarn or the third yarn, wherein the second region does not include stitches of the first yarn or the third yarn, and wherein the first yarn meets the second yarn at a first boundary that separates the first region and the second region, and a second boundary separates the third region from the first region or the second region; and forming a textured element by controlling motorized carriers of the knitting machine to move the needles to knit the textured element into at least one of the first region, the second region, and the third region, wherein the textured element comprises stitches of a first knitting stitch and stitches of a remainder of the first, second and third regions comprise stitches of a second knitting stitch that differs from the first knitting stitch, wherein the first knitting stitch comprises single jersey, half Milano, pique, or mesh such that the textured element comprises an area that is recessed or raised relative to a remainder of the first region, the second region, or the third region in which the textured element is knitted;

wherein the textured element extends across the first boundary, the second boundary, or the first and second boundaries, such that the textured element is different than the color layout and such that the area that is recessed or raised extends across the first boundary, the second boundary, or the first and second boundaries and is recessed or raised relative to adjacent portions of the first boundary, the second boundary, or the first and second boundaries.

13. The method of claim 12, wherein knitting the first region, the second region, and the third region comprises intarsia knitting.

14. The method of claim 12, wherein knitting the first region, the second region, and the third region comprises knitting using an 18 gauge knitting machine.

15. The method of claim 12, wherein the textured element is knitted into at least two of the first region, the second region, and the third region.

16. The method of claim 12, wherein the first yarn is a first dyed yarn, and wherein the second yarn is a second dyed yarn.

17. A knitted article of apparel comprising:

a first knitted region comprising a plurality of stitches in a plurality of courses of a first yarn having a first color;

a second knitted region comprising a plurality of stitches in a plurality of courses of a second yarn having a second color that differs from the first color, wherein the second yarn of the second knitted region meets the first yarn of the first knitted region at a boundary extending in a first direction, wherein the first knitted region does not include stitches of the second yarn, and wherein the second knitted region does not include stitches of the first yarn; and a textured element knitted into the first knitted region and the second knitted region, wherein the textured element comprises stitches of a first knitting stitch and a remainder of the plurality of stitches of the first knitted region comprises stitches of a second knitting stitch that differs from the first knitting stitch, wherein the first knitting stitch comprises single jersey, half Milano, pique, or mesh, wherein the textured element comprises a recessed area on an exterior surface of the knitted article, and wherein the textured element is recessed relative to a remainder of the first knitted region and the second knitted region;

wherein the first knitted region and the second knitted region form at least a portion of a color layout;

wherein the textured element extends lengthwise in a second direction across the boundary of the second knitted region and the first knitted region such that the textured element has a layout that differs from the color layout, and wherein the second direction is different than the first direction.

18. The knitted article of claim 17, wherein the knitted article comprises a shirt, a jacket, pants, leggings, a sports bra, or a shoe upper.

19. The knitted article of claim 17, further comprising a mesh portion arranged in at least one of the first knitted region and the second knitted region.

* * * * *